US010246292B2

(12) United States Patent
Burchert

(10) Patent No.: US 10,246,292 B2
(45) Date of Patent: Apr. 2, 2019

(54) YARN CLEARER AND SPINNING STATION, EQUIPPED THEREWITH, OF A SPINNING MACHINE, AND METHOD FOR OPERATING A SPINNING STATION

(71) Applicant: Maschinenfabrik Rieter AG, Winterthur (CH)

(72) Inventor: Mathias Burchert, Ostfildern (DE)

(73) Assignee: Maschinenfabrik Rieter AG, Winterthur (CH)

( * ) Notice: Subject to any disclaimer, the term of this patent is extended or adjusted under 35 U.S.C. 154(b) by 414 days.

(21) Appl. No.: 15/026,556

(22) PCT Filed: Oct. 1, 2014

(86) PCT No.: PCT/EP2014/071055

§ 371 (c)(1),
(2) Date: Mar. 31, 2016

(87) PCT Pub. No.: WO2015/049293

PCT Pub. Date: Apr. 9, 2015

(65) Prior Publication Data

US 2016/0221790 A1 Aug. 4, 2016

(30) Foreign Application Priority Data

Oct. 1, 2013 (DE) ..... 10 2013 110 897

(51) Int. Cl.
*B65H 63/036* (2006.01)
*B65H 63/06* (2006.01)
(Continued)

(52) U.S. Cl.
CPC ..... *B65H 63/036* (2013.01); *B65H 63/062* (2013.01); *D01H 4/50* (2013.01); *D01H 13/22* (2013.01); *B65H 2701/31* (2013.01)

(58) Field of Classification Search
CPC ..... D01H 13/22; B65H 63/036; B65H 63/062
See application file for complete search history.

(56) References Cited

U.S. PATENT DOCUMENTS 5,181,374 A * 1/1993 Aeppli ..... B65H 63/062 28/227
5,537,811 A * 7/1996 Pidoux ..... B65H 63/062 28/226

(Continued)

FOREIGN PATENT DOCUMENTS

CN 87200201 U 10/1987
CN 1 867 508 A 11/2006

(Continued)

OTHER PUBLICATIONS

Machine Translation of EP 2078770 A2, Jul. 15, 2009 (Specification). *

(Continued)

*Primary Examiner* — Shaun R Hurley
(74) *Attorney, Agent, or Firm* — Dority & Manning, P.A.

(57) ABSTRACT

The invention relates to a spinning station (1) of a spinning machine, wherein the spinning station (1) has a spinning means (2) for producing a yarn (3) from a sliver (4) fed to the spinning means (2), wherein the spinning station (1) has a winding apparatus (20) for winding the yarn (3) onto a package (16), said winding apparatus (20) being arranged downstream of the spinning means (2) in a transport direction of the yarn (3), wherein the spinning station (1) has a yarn clearer (5) arranged between the spinning means (2) and the winding apparatus (20), the yarn being monitorable for yarn defects with the aid of said yarn clearer (5), and wherein the spinning station (1) is assigned a controller (6) which is configured to interrupt the production of the yarn (3) if a defined yarn defect is detected. The invention proposes that the spinning station (1) has an information unit (Continued)

(7) with the aid of which it is possible to display to an operator of the spinning station (1) how much yarn (3) has to be at least unwound from the package (16) located in the winding apparatus (20) following the interruption to the yarn production in order to ensure that the yarn section having the yarn defect has been completely removed from the package (16). Furthermore, a yarn clearer and a method for operating a spinning station are proposed.

11 Claims, 2 Drawing Sheets

(51) Int. Cl.
*D01H 4/50* (2006.01)
*D01H 13/22* (2006.01)

(56) References Cited

U.S. PATENT DOCUMENTS 5,862,660 A 1/1999 Haasen et al.
6,533,211 B2 3/2003 Kargel et al.
7,392,648 B2 * 7/2008 Biermann ..... D01H 1/16 57/264
7,424,800 B2 9/2008 Biermann et al.
7,721,519 B2 * 5/2010 Grecksch ..... D01H 4/42 57/209
7,832,190 B2 * 11/2010 Meixner ..... G01N 33/365 57/265
2002/0023422 A1 * 2/2002 Stephan ..... B65H 51/205 57/400
2002/0023982 A1 2/2002 Kargel et al.
2002/0074445 A1 6/2002 Oehrl et al.
2008/0276593 A1 * 11/2008 Meixner ..... G01N 33/365 57/264
2009/0223199 A1 * 9/2009 Wassenhoven ..... D01H 1/16 57/362
2010/0071341 A1 * 3/2010 Lassmann ..... D01H 4/50 57/263
2013/0346007 A1 * 12/2013 Schmid ..... B65H 63/062 702/84

FOREIGN PATENT DOCUMENTS

CN 203080157 U 7/2013
DE 196 40 184 4/1998
DE 10 020 665 A1 10/2001
EP 1 151 951 11/2001
EP 1 215 154 6/2002
EP 1 659 082 5/2006
EP 2 078 770 7/2009

OTHER PUBLICATIONS

IPRP, Apr. 5, 2016.
PCT Search Report, dated Dec. 4, 2014.
Chinese Office Action, dated May 8, 2018.

* cited by examiner a)

b)

YARN CLEARER AND SPINNING STATION, EQUIPPED THEREWITH, OF A SPINNING MACHINE, AND METHOD FOR OPERATING A SPINNING STATION

FIELD OF THE INVENTION

This invention relates to a spinning station of a spinning machine, wherein the spinning station has a spinning means for producing a yarn from a sliver fed to the spinning means, and a winding apparatus for winding the yarn onto a package, the winding apparatus arranged downstream of the spinning means in a transport direction of the yarn. The spinning station also has a yarn clearer arranged between the spinning means and the winding apparatus, the yarn being monitorable for yarn defects with the aid of the yarn clearer. The spinning station is assigned a controller that is configured to interrupt the production of the yarn if a defined yarn defect is detected.

Further, a yarn clearer for a spinning station of a spinning machine is described, wherein the spinning station has a spinning means for producing a yarn from a sliver fed to the spinning means and a winding apparatus for winding the yarn onto a package, the winding apparatus arranged downstream of the spinning means in a transport direction of the yarn. The spinning station is assigned a controller which is configured to interrupt the production of the yarn if a defined yarn defect is detected.

Finally, the subject matter of the invention includes a method for operating a spinning station of a spinning machine, wherein, during normal operation, a sliver is fed to a spinning means of the spinning station and a yarn is produced from the sliver with the aid of the spinning means and is wound on a package with the aid of a winding apparatus arranged downstream of the spinning means in a transport direction of the yarn. The yarn is monitored for yarn defects with the aid of a yarn clearer arranged between the spinning means and the winding apparatus, and wherein the production of the yarn is interrupted if a defined yarn defect is detected.

BACKGROUND

Corresponding yarn clearers are known from the state of the art and are used for monitoring the yarn produced by the respective spinning means (a rotor with a rotor spinning machine, an air jet spinning nozzle with an air jet spinning machine, etc.) of the spinning station. In addition to short variations in thickness of the yarn, fluctuations in yarn thickness over larger lengths of yarn (several meters), changes in the hairiness of the yarn, or other yarn properties, which could adversely affect the subsequent processing chain of the yarn, such as the enmeshing or interweaving of the same, are typically monitored.

With semi-automatic spinning machines, the detection of yarn defects takes place automatically with the aid of corresponding yarn clearers along with the interruption of yarn production if unacceptable yarn defects are detected. Subsequently, however, the interrupted spinning process must be restarted by initiating a piecing process by an operator. In doing so, it is initially essential that the yarn section having the yarn defect is removed from the remaining yarn.

Since, upon yarn production being stopped, not all of the previously moving components of the spinning station are to be immediately stopped, the yarn defect is usually located on the package after the interruption of yarn production. Thus, a certain length of yarn initially must be drawn out from the package, wherein it must be ensured that the drawn-out yarn also includes the previously detected yarn defect. With short yarn defects, this is still possible with a fair level of reliability, since the operator only has to remove one to two meters of yarn in such a case. For longer yarn defects, with which more than two meters of yarn must be removed, there is a large risk that the yarn section having the yarn defect is not completely removed from the package by the operator. Upon the subsequent piecing process, the yarn section having the yarn defect, or at least a part thereof, is brought into contact with the sliver to be spun, and finally arrives back to the package, without thereby being detected. The task of this invention is to propose an option that takes into account the problem set forth above.

SUMMARY OF THE INVENTION

The task is solved by a spinning station, a yarn clearer and a method with the characteristics described and claimed herein. Additional objects and advantages of the invention will be set forth in part in the following description, or may be obvious from the description, or may be learned through practice of the invention.

First, a spinning station of a spinning machine is proposed, wherein the spinning station comprises a spinning means for producing a yarn from a sliver fed to the spinning means. The spinning means may be, for example, a rotor (if the spinning machine is a rotor spinning machine). The spinning means may also be designed as an air jet spinning nozzle, such that the spinning station in accordance with the invention may also be a spinning station of an air jet spinning machine, with which yarn production takes place with the aid of a vortex air flow. Furthermore, the spinning station comprises a winding apparatus arranged downstream of the spinning means in a transport direction of the yarn, with the aid of which the yarn produced by the spinning means can be wound on a package.

Further, the spinning station has a yarn clearer arranged between the winding apparatus and the spinning means, with the aid of which the yarn is monitored for yarn defects. The yarn clearer preferably comprises a visual and/or capacitive sensor, which is passed by the yarn and which is designed to monitor defined parameters (such as the thickness and/or hairiness) of the yarn during yarn production.

Finally, the spinning station is assigned a controller (which may be a part of the spinning station or a center section of a spinning machine comprising multiple spinning stations). The controller is designed to interrupt the production of the yarn if a defined yarn defect is detected. A defined yarn defect comprises, in particular, a deviation in yarn thickness from specified limit values over a defined length of yarn.

In order to assist the operator in ensuring that the correct length of yarn is removed from the package (that is, a length of yarn that is sufficiently measured such that the yarn defect triggering the interruption of yarn production has been completely removed from the package), it is now proposed that the spinning station has an information unit, with the aid of which it is possible to display to an operator of the spinning station how much yarn has to be at least unwound from the package located in the winding apparatus in order to ensure that the yarn section having the yarn defect has been completely removed from the package. Thus, the operator does not only receive the information that an interruption in yarn production has taken place. Rather, the information unit also displays to him how much yarn (i.e., what yarn length) he must unwind from the package before the subsequent piecing process can take place. For this purpose, the information unit is preferably installed permanently at the respective spinning station, wherein each spinning station of the spinning machine should have its own information unit.

In all other respects, the term "information unit" is understood to be any structural unit that is suitable for presenting length specifications in graphic or visual terms. For example, it is conceivable that the information unit includes a display on which the length specifications (for example, 2 meters) can be displayed.

In addition, the information unit should be in connection with the controller assigned to the spinning station or a data processing unit of the yarn clearer, in order to be able to receive information relating to the yarn defect detected prior to the interruption of yarn production (in particular, its length).

It is particularly advantageous if the information unit includes multiple display elements. Further, each display element should represent a defined length of yarn that has to be unwound from the package. For example, it is conceivable that the information unit comprises several light sources (for example, in the form of LEDs, or light-emitting diodes), wherein each light source is labeled with a length of yarn to be unwound. Thus, for example, one light source could be labeled with a length specification between one and five meters, while a second light source could be labeled with a length specification between five and 15 meters. If, for example, the light source that is labeled with the "2 m" specification lights up, the operator knows that he has to unwind at least two meters of yarn from the package and cut them off from the remaining yarn, in order to ensure that the yarn defect previously detected by the yarn clearer has been completely removed and thus cannot once again be wound on the package during the subsequent piecing process.

Furthermore, it is advantageous if the information unit comprises one (preferably separate) display element, with the aid of which it can be signaled to the operator that the package must be removed from the winding apparatus, since the length of the yarn section having the yarn defect exceeds a predetermined maximum length. For example, it is conceivable that the yarn has only a small deviation in thickness from a target value. However, if this deviation is detected over a longer length of yarn (for example, more than 30 meters), this typically refers to a fundamental malfunctioning of the spinning station, in particular the spinning means, which must be remedied in order to once again produce yarn that is defect-free. Moreover, the display element may also comprise a light source (such as an LED) that is activated by the controller or the data processing unit of the yarn clearer if the package must be completely removed, since, based on the length of this section, a removal of the entire yarn section having the yarn defect no longer appears to be sensible.

It is particularly advantageous if the information unit is a component of the yarn clearer. Indeed, it is also conceivable to design the information unit as a unit detached from the yarn clearer and place it in a location of the spinning station visible to the operator. However, if the information unit is a part of the yarn clearer, it may be directly (i.e., without external wiring) driven by the data processing unit of the yarn clearer. Since this also evaluates the data of the sensor or sensors that monitor the previously selected yarn parameters (such as yarn thickness), it is ultimately possible with the aid of only one structural unit, namely the yarn clearer, to monitor the yarn for yarn defects and, after the detection of a yarn defect that results in the interruption of yarn production, notify the operator of how much yarn must be removed from the package before a piecing process can take place.

Therefore, the yarn clearer in accordance with the invention has an information unit, with the aid of which it is possible to visually display to an operator of the spinning station how much yarn has to be at least unwound from the package located in the winding apparatus following the interruption to the yarn production in order to completely remove the yarn section having the yarn defect from the package. In particular, the information unit may have one or more of the features described in the preceding or in the following.

Further, the yarn clearer comprises one or more visual and/or capacitive sensors, with the aid of which, preferably, the yarn thickness and/or the hairiness of the passing yarn can be determined (hairiness is a measure of the length and/or intensity of the fiber ends and/or loops protruding from the yarn package).

Finally, the yarn clearer should include a data processing unit, with the aid of which the data of the specified sensor(s) is evaluated. For example, it is conceivable that the data processing unit compares the measured values determined through the sensors with predetermined target values or limit values, and ultimately divides any detected yarn defects into individual categories. Finally, depending on the category, it would be possible for the data processing unit to individually forward its signal to the information unit. Depending on this signal, visual information is ultimately issued to the operator through the information unit that shows how much yarn has to at least be removed from the package before a piecing process can be initiated.

Finally, a method for operating a spinning station of a spinning machine is proposed, with which, during normal operation, a sliver is fed to a spinning means (such as a rotor or an air jet spinning nozzle) of the spinning station. A yarn is produced from the sliver with the aid of the spinning means, and is wound on the package with the aid of a winding apparatus arranged downstream of the spinning means in a transport direction of the yarn. To monitor the quality of the yarn, a yarn clearer is further provided, with the aid of which the yarn is monitored for yarn defects between the spinning means and the winding apparatus. With respect to possible yarn defects or possible characteristics of the yarn clearer, reference is made to the previous or following description.

Furthermore, it is provided that the production of yarn is interrupted if a defined yarn defect is detected and at least the yarn section having the yarn defect is removed, in order to ensure that only already wound packages that do not have yarn defects that adversely affect the subsequent processing chain of the yarn leave the spinning station.

In order to provide the operator with information as to how much yarn must be unwound from the package after an interruption of yarn production based on a yarn defect, the invention proposes that, with the aid of an information unit of the spinning station, how much yarn that has to be at least unwound from the package located in the winding apparatus is displayed to the operator of the spinning station after the interruption of yarn production in order to completely remove the yarn section having the yarn defect from the package. Thus, at the information unit, the operator is able to read a length specification, for example "9 m." Ultimately, on the basis of this specification, he knows how much yarn has to be at least removed from the package.

While it is conceivable that the information unit (for example, through a corresponding display) always precisely indicates the length that must be unwound from the package, it is also advantageous if each yarn defect detected by the yarn clearer is divided into one of several categories depending on the length of the respective yarn section having the yarn defect (for example, first category: length of the yarn section having the yarn defect <2 m, second category: 2 m<length of the yarn section having the yarn defect <9 m, third category: length of the yarn section having the yarn defect >9 m). The length of yarn to be unwound, as indicated by the information unit, is ultimately selected depending on the respective category, preferably by the data processing unit internal to the yarn clearer. For example, it is conceivable that a display element of the information unit is activated if the yarn section having the yarn defect has a length of a maximum of two meters. A second display element could light up if the yarn section having the yarn defect has a length that is between 2 meters and 9 meters, etc. Thus, in this case, the display elements of the information unit are controlled by the yarn clearer itself, which uses the information from the categorization of the detected yarn defects.

It is particularly advantageous if, with the aid of the information unit, the operator is signaled that the package must be removed from the winding apparatus as soon as the length of the yarn section having the yarn defect exceeds a predetermined maximum length. If the yarn defect extends, for example, over a length of yarn of more than 10 meters, for reasons of high efficiency, it is typically no longer sensible to remove this long yarn section from the package. Rather, in this case, it is preferable to completely remove the package and to begin with the winding of a new package.

Finally, it is advantageous if the length of the yarn section having the yarn defect is determined with the aid of a sensor of the yarn clearer itself. In this case, the yarn clearer thus includes a sensor, with the aid of which the length of the yarn passing the yarn clearer can be determined. In this manner, the yarn clearer is able to detect a yarn defect and at the same time determine the length of the yarn section that has passed the yarn clearer after the detection of the yarn defect. After evaluating the corresponding measurement signals, the yarn defect can ultimately activate the display element(s) in such a manner that the operator precisely knows how much yarn must be removed from the package prior to the subsequent piecing process.

BRIEF DESCRIPTION OF THE DRAWINGS

Additional advantages of the invention are described in the following embodiments. The following is shown, in each case schematically.

DETAILED DESCRIPTION

Figure 1:
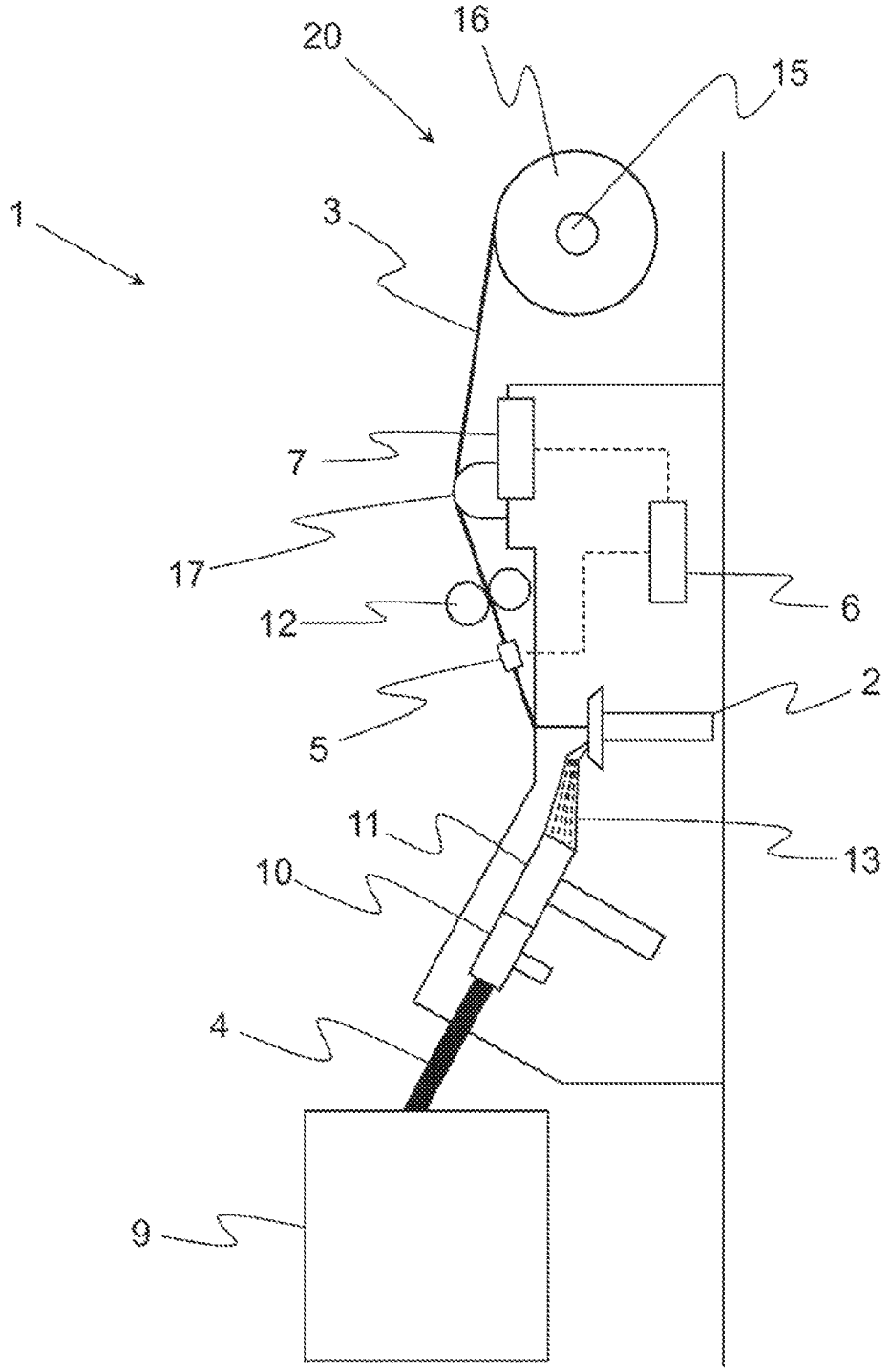
FIG. 1 a side view of a spinning station of a rotor spinning machine.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 schematically shows a side view of a spinning station 1 of a rotor spinning machine. Rotor spinning machines are well-known in the state of the art, such that the essential units of a corresponding spinning machine are only briefly addressed below.

In principle, the spinning station 1 that is shown includes a feed roller 10, with the aid of which a sliver 4 coming from (for example) a spinning can 9 is fed to an opening roller 11, which in turn causes a separation of the fibers of the sliver 4. By means of negative pressure, the fibers are finally sucked through a feed channel 13 into the area of spinning means 2 designed as a rotor in the illustrated embodiment, and are rotated by the spinning means 2 to form a yarn 3.

The yarn 3 is drawn off out of the spinning means 2 by a pair of draw-off rollers 12 (or other draw-off means) and, possibly after passing through a paraffin coating 17, finally arrives in the area of a winding apparatus 20. There, it is wound on a package 16 driven around a package axis 15.

In order to ensure the quality of the yarn 3 (i.e., specific yarn properties, such as its thickness or hairiness) during yarn production, the spinning station 1 must be monitored and includes a so-called "yarn clearer" 5, which the yarn passes during the production and winding process.

Figure 2:
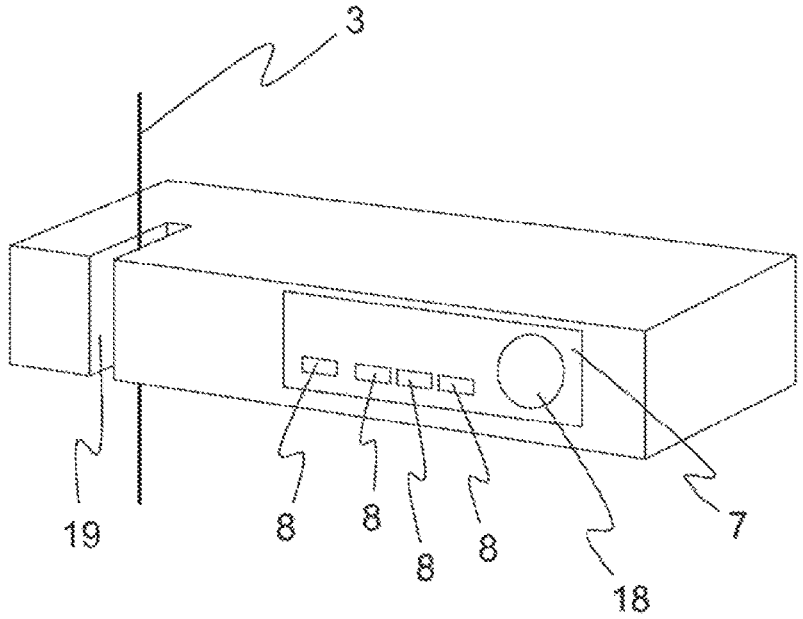
FIG. 2 a yarn clearer (FIG. 2*a*) and an information unit of the same in detail (FIG. 2*b*).
Figure 2:
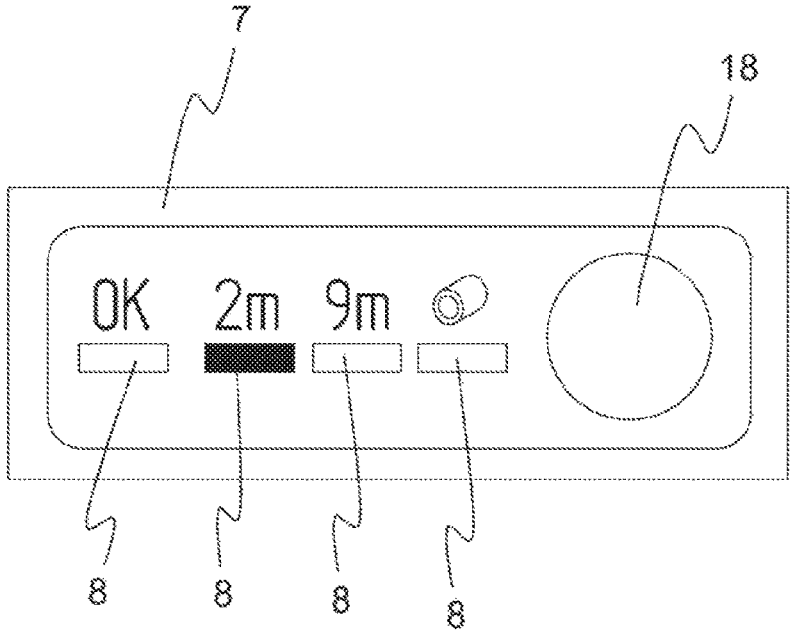

As can be seen in FIG. 2*a*), for example, the yarn clearer 5 typically includes a measuring gap 19 through which the yarn 3 passes, in the area of which, depending on the type of yarn clearer 5, one or more visual and/or capacitive sensors are arranged, which monitor the passing yarn 3 with respect to accordingly defined parameters.

If a yarn defect that cannot be tolerated is then detected by the yarn clearer 5 (that is, a deviation of one or more yarn parameters from one or more limit values), yarn production is stopped by shutting down the feed roller 10, the opening roller 11 and the spinning means 2. At the same time, the winding apparatus 20 is stopped, wherein the inertia of the package 16 leads to the fact that the end of the yarn produced by the interruption of yarn production is completely wound on the package 16.

Before the end of the yarn can be led back into the area of the spinning means 2 in order to be connected to the re-fed sliver 4, the section having the yarn defect must be removed from the wound yarn 3, wherein, with so-called "semi-automatic spinning machines," this must take place manually at least for the most part.

If the operator then arrives at the spinning station 1, at which a yarn interruption arose due to a yarn defect, he initially does not know whether the yarn defect is short or long. In other words, he does not know how much yarn 3 must be removed from the package 16 in order to ensure that he has removed from the package 16 the entire yarn section having the yarn defect (this section must be removed from the remaining yarn 3 in order to prevent the yarn defect from being wound back onto the package 16 after a piecing process).

In order to then provide the operator with assistance in unwinding the yarn section having the yarn defect, it is proposed that the spinning station 1 be equipped with an information unit 7 that displays the length of yarn to be unwound. The information unit 7 preferably includes one or more display elements 8, with the aid of which either the exact length of yarn to be unwound or alternatively the minimum length that is to be unwound can be displayed, in order to also have removed with certainty the entire yarn defect from the package 16.

As indicated in FIG. 1, the information unit 7 may be located at a location remote from the yarn clearer 5, wherein the yarn clearer 5 and the information unit 7 preferably may be connected to a common controller 6 or even directly with the aid of corresponding wires 14.

In a particularly advantageous embodiment of the invention, however, the information unit 7 is a component of the yarn clearer 5. FIG. 2*a*) shows a possible embodiment. As this figure shows, the information unit 7 may be arranged in the area of the front side turned towards the operator and, for example, on the side of the measuring gap 19. While a display on which the exact length of yarn to be unwound is shown would also be possible, an information unit 7 shown in FIG. 2*b*) has proven successful. As the mentioned figure shows, the information unit 7 preferably has multiple display elements 8 with a corresponding length specification (see the two center display elements 8). If, for example, as indicated in FIG. 2*b*) by the black display element 8, the display element 8 that is located below the specification "2 m" lights up, the operator knows that he must unwind at least two meters of yarn 3 from the package 16 and then sever them from the remaining yarn 3, in order to completely remove the yarn defect. Accordingly, one or more additional display elements 8, which are labeled with an additional length specification, may be present.

If the yarn section that is produced up to the interruption of yarn production is so long that an unwinding of the package 16 is no longer profitable, a replacement of the entire package 16 would be sensible. In order to display this to the operator, the information unit 7 may include an additional display element 8 (see the display element 8 to the right in FIG. 2*b*), identified by a package.

The information unit 7 may also include a display element 8, which remains active (that is, for example, lit up) until the detection of a yarn defect arises (see FIG. 2*b*): left display element 8 with the exemplary label of "OK").

Finally, the yarn clearer 5 may include a reset switch 18, with the aid of which the yarn clearer 5 and/or the controller 6 can be informed by the operator that the yarn defect has been removed and the pending piecing process may be carried out.

The present invention is not limited to the illustrated and described embodiments. Variations within the framework of the claims, such as any combination of the described characteristics, even if they are illustrated and described in different parts of the description or the claims or in different embodiments. For example, the described yarn clearer may of course also be used on air jet spinning machines or other spinning machines, with which a yarn is to be monitored for yarn defects.

LIST OF REFERENCE SIGNS

1 Spinning station
2 Spinning means
3 Yarn
4 Sliver
5 Yarn clearer
6 Controller
7 Information unit
8 Display element
9 Spinning can
10 Feed roller
11 Opening roller
12 Pair of draw-off rollers
13 Feed channel
14 Wire
15 Package axis
16 Package
17 Paraffin coating
18 Reset switch
19 Measuring gap
20 Winding apparatus

The invention claimed is:

1. A spinning station of a spinning machine, comprising:
a spinning means for producing a yarn from a sliver fed to the spinning means;
a winding apparatus that winds the yarn from the spinning means onto a package, the winding apparatus arranged downstream of the spinning means in a transport direction of the yarn;
a yarn clearer arranged between the spinning means and the winding apparatus, the yarn clearer configured to monitor for yarn defects in the yarn prior to the yarn being wound onto the package;
a controller in communication with the yarn clearer and configured to interrupt production of the yarn upon detection of a defined yarn defect by the yarn clearer; and
an information unit in communication with the controller and disposed so as to be visible to an operator of the spinning station, the information unit comprising a display that, prior to yarn being unwound from the package, visibly informs the operator of a minimum yarn length to subsequently unwind from the package following the interruption of yarn production in order to ensure that the yarn defect will be completely removed from the package.

2. The spinning station according to claim 1, wherein the display comprises individual display elements, each display element representing a defined length of yarn to be unwound from the package in order to ensure that the yarn defect has been completely removed from the package.

3. The spinning station according to claim 1, wherein the display comprises an individual display element that indicates to the operator that the package is to be removed from the winding apparatus because the length of yarn to be unwound from the package exceeds a predetermined maximum length.

4. The spinning station according to claim 1, wherein the information unit is a component of the yarn clearer.

5. A yarn clearer for a spinning station of a spinning machine, wherein the spinning station has a spinning means for producing a yarn from a sliver fed to the spinning means, a winding apparatus for winding the yarn onto a package, a controller configured to interrupt production of the yarn if a defined yarn defect is detected, the yarn clearer comprising:
an information unit disposed so as to be visible to an operator of the spinning station, the information unit comprising a display that, prior to yarn being unwound from the package, visibly informs the operator of a minimum yarn length to subsequently unwind from the package following the interruption of yarn production in order to ensure that the yarn defect will be completely removed from the package.

6. The yarn clearer according to claim 5, wherein the display comprises individual display elements, each display element representing a defined length of yarn to be unwound from the package in order to ensure that the yarn defect has been completely removed from the package.

7. The yarn clearer according to claim 5, wherein the display comprises an individual display element that indicates to the operator that the package is to be removed from the winding apparatus because the length of yarn to be unwound from the package exceeds a predetermined maximum length.

8. A method for operating a spinning station of a spinning machine where a sliver is fed to a spinning means for production of a yarn, the method comprising:

winding the yarn produced by the spinning means on a package with a winding apparatus arranged downstream from the spinning means in a transport direction of the yarn;

monitoring the yarn for yarn defects with a yarn clearer arranged between the spinning means and the winding apparatus;

interrupting production of the yarn if a defined yarn defect is detected by the monitoring step; and with an information unit, prior to unwinding yarn from the package, displaying to an operator a minimum length of yarn to subsequently unwind from the package after the interruption of yarn production in order to ensure that the yarn defect will be completely removed from the package.

9. The method according to claim 8, wherein the yarn defect detected by the yarn clearer is assigned to one of several categories depending on the length of yarn having the yarn defect, and that the length of yarn to be unwound displayed by the information unit is selected depending on the respective category.

10. The method according to claim 8, wherein the information unit signals to the operator that the package is to be removed from the winding apparatus when the length of yarn to be unwound exceeds a predetermined maximum length.

11. The method according to claim 8, wherein the length of the yarn having the yarn defect is determined with a sensor configured with the yarn clearer.

* * * * *